United States Patent [19]

Rupert

[11] 4,221,551

[45] Sep. 9, 1980

[54] SLIDING VALVE PUMP

[76] Inventor: Clement L. Rupert, P.O. Box 774, Haynesville, La. 71038

[21] Appl. No.: 919,370

[22] Filed: Jun. 26, 1978

[51] Int. Cl.[3] ..... F04B 21/02

[52] U.S. Cl. ..... 417/511; 417/566

[58] Field of Search ..... 417/511, 518, 435, 571

[56] References Cited

U.S. PATENT DOCUMENTS

| | | | |
|---|---|---|---|
| 827,205 | 7/1906 | Betker | 417/518 |
| 1,575,250 | 3/1926 | Brittain | 417/260 |
| 1,783,425 | 12/1930 | Hunter | 417/518 |
| 1,866,026 | 7/1932 | Gerken | 417/518 |
| 2,141,957 | 12/1938 | McDaniel | 417/509 |
| 2,363,343 | 11/1944 | Lindgren | 417/435 |
| 2,685,257 | 8/1954 | Goldschmidt | 417/520 |
| 2,787,225 | 4/1957 | Rotter | 417/489 |
| 3,026,812 | 3/1962 | Carty | 417/518 |
| 3,292,552 | 12/1966 | Chancellor et al. | 417/571 |
| 3,469,532 | 9/1969 | Wegmann et al. | 417/549 |
| 3,578,886 | 5/1971 | Nino | 417/509 |
| 4,087,212 | 5/1978 | Holder | 417/511 |

*Primary Examiner*—William L. Freeh

[57] ABSTRACT

A sliding valve pump for oil wells which includes a working barrel having a plurality of apertures located in spaced relationship in the wall thereof and a pair of travelling valves fitted within the working barrel and carried by a plunger rod, the valves also having a plurality of apertures or ports for periodic registration with the ports in the working barrel wall to facilitate pumping of fluid from an oil reservoir or pool to the surface. The pump is designed to pull the oil-gas mixture from the reservoir pool into the lower section of the working barrel on the downward stroke, and to subsequently pump the collected oil through the barrel and tubing upwardly toward the surface on the upward stroke.

11 Claims, 11 Drawing Figures

SLIDING VALVE PUMP

BACKGROUND OF THE INVENTION

1. Field of the Invention

This invention relates to oil pumps, and more particularly to tubing mounted oil well pumps which are activated by pumping units and cooperating sucker rod strings designed to pump oil from pools or reservoirs beneath the earth's surface. The pumps are typically fitted to tubing set in the fluid reservoir of a drilled oil well, and are activated by a string of sucker rods driven in reciprocating fashion by a surface-located pumping unit. The reciprocating action of the sucker rods causes travelling valves located within the working barrel of the pump and carried by a plunger rod in cooperation with the sucker rods, to pump the well fluid from the reserfoir to the surface.

2. Description of the Prior Art

Oil field pumps of the travelling and check valve design have been long known in the art. Typical of such pumps is the well known ball check travelling valve oil well pump, which is characterized by a working barrel, and a plunger and cooperating travelling valve in cooperation with the sucker rod string and driving unit where upward strokes of the sucker rod string and plunger rod cause fluid to flow from the reservoir in which the pump is submerged, through the bottom of the working barrle against an unseated ball check, and into a lower chamber of the pump, thus filling the chamber with fluid. Subsequent downward strokes of the sucker rod string and plunger rod effect a displacement of the upper ball check from its seat in the travelling valve, due to movement of the fluid from the lower chamber into the upper chamber, and the fluid moves on through a port in the wall of the working barrel into the tubing annulus on its way to the surface.

One of the problems associated with pumps of this design has been fluid "lock"m, a phenomenon which necessitates pulling of the pump through the tubing to the surface and correcting the problem, sometimes at great expense. Fluid or gas "lock" frequently occurs when gas is trapped in the pump and acts as a shock absorber which effectively prevents the pump from lifting fluid. Both this condition and the fluid "pound" problem, which are well known to those skilled in the art, are responsible for expense in the oil field.

Accordingly, it is an object of this invention to provide a new and improved sliding valve pump for oil wells which eliminates the necessity for the use of balls and checks in the pumping operation, and which provides a flow of fluid from the reservoir through aligned ports in the wall of the working barrel by operation of a pair of travelling valves.

Another object of the invention is to provide a new and improved oil field pump for use with pumping units and cooperating sucker rod strings which eliminates the problem of fluid and gas "lock" by operation of a pair of travelling valves which permit venting of the gas causing the lock through the wall of the pump.

Yet another object of the invention is to provide a new and improved tubing-mounted travelling valve pump for oil wells which is suspended from the tubing and extends into the oil reservoir below the tubing and is designed to receive well fluid from registering ports in the working barrel and the bottom travelling valve to permit venting of pressure in the working barrel and eliminate gas "lock".

Another object of the invention is to provide a sucker rod-activated oil well pump which utilizes a plunger to seal the bottom of the working barrel and receives fluid through a system of ports in the working barrel walls with the achievement of maximum flow and efficiency and minimum turbulence.

Still another object of the invention is to provide a new and improved oil field pump of the travelling valve design which receives reservoir fluid through registering ports in the valves and working barrel, and is designed to eliminate the necessity for fluid intake through the bottom of the working barrel.

Yet another object of the invention is to provide a new and improved tubing mounted fluid reservoir pump which is characterized by a working barrel and a pair of travelling valves slidably positioned in the barrel, with fluid entry and exit achieved by registration of ports provided in the valves and the working barrel.

A still further object of the invention is to provide a travelling valve oil pump with side ports, which is capable of effectively pumping a fluid mixture of liquid and gas without gas "lock".

SUMMARY OF THE INVENTION

These and other objects of the invention are provided in a new and improved sliding valve pump of travelling valve design, which is characterized by a working barrel having a plurality of apertures or ports in the wall thereof, and a pair of sliding valves mounted in tandem relationship on a common plunger rod and also equipped with a plurality of ports or wall openings for sequential registration with the ports in the working barrel, the pump being activated by the stroking action of a sucker rod string and the cooperating plunger rod.

BRIEF DESCRIPTION OF THE DRAWING

The invention will be better understood in view of the following description presented with reference to the accompanying drawings.

FIG. 11 is a sectional view of the working barrel and port system of the pump of this invention, taken along lines 11—11 of FIG. 6.

DESCRIPTION OF THE PREFERRED EMBODIMENT

Figure 2:
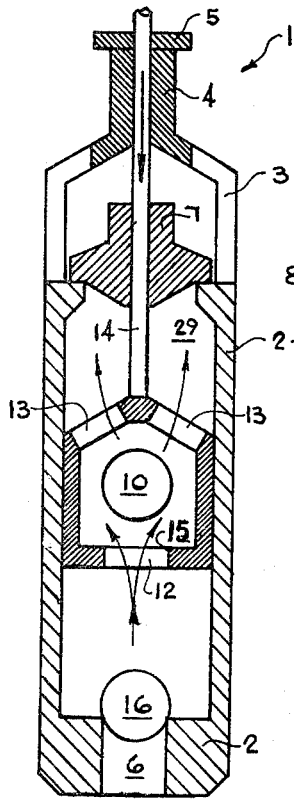
FIG. 2 (prior art)
FIG. 2 is another sectional view of the pump illustrated in FIG. 1, more particularly showing the pumping of fluid from the lower chamber of the pump through the travelling valve ball to the upper pump chamber by means of a downward stroke of the sucker rod and plunger rod combination.
Figure 1:
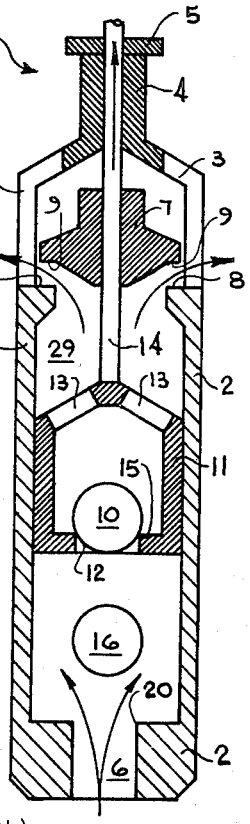
FIG. 1 (prior art)
FIG. 1 is a sectional view of a conventional oil well pump having a travelling valve and ball check combination, and illustrating the pumping of fluid from a fluid reservoir in an oil well into the lower chamber of the pump and out of the pump by upward stroke action of the sucker and plunger rod system.

Referring now to FIGS. 1 and 2 of the drawing, conventional oil pump 1 is illustrated, and includes working barrel 2, with barrel neck 4 and barrel neck flange 5, and further equipped with fluid inlet 6 and fluid outlet 3. The top valve 7 is provided in the upper interior of working barrel 2, and serves to seal the upper chamber of working barrel 2 from the lower chamber thereof by mating valve seal 9 and valve seat 8 when top valve 7 is closed, as illustrated in FIG. 2. The lower segment of working barrel 2 is served by a top ball check 10, enclosed in ball cage 11, the latter of which is fitted with a cage inlet aperture 12 and cage outlet apertures 13, to permit fluid to flow from the bottom chamber of working barrel 2 through cage inlet aperture 12 and ball cage 11, and into the upper chamber of working valve 2. Cage plunger 14 carries ball cage 11 and constrains ball cage 11 to travel with the plunger in reciprocating fashion responsive to the action of a conventional pumping unit located on the surface, and a cooperating sucker rod string, (not illustrated) the bottom rod of which is attached to plunger 14. Top ball seat 15 is provided around the top periphery of cage inlet aperture 12 in order to seal the middle chamber of working barrel 2 from the lower chamber thereof. A bottom ball check 16 is located in the bottom chamber of working barrel 2 and serves to seal fluid inlet 6 by contact with bottom ball seat 20 when fluid is being pumped from the lower chamber of working barrel 2 to the upper chamber thereof.

In operation, referring now to FIG. 2 of the drawing, when the sucker rod string in the well is caused to move downwardly by action of the pumping unit, cage plunger 14, which is connected to the sucker rod string, also moves downwardly, moving ball cage 11 downwardly and forcing fluid trapped in the bottom area of working barrel 2 upwardly through cage inlet aperture 12 into the middle chamber of working barrel 2 as top ball 10 is displaced from top ball seat 15. This movement of the pumped fluid is indicated by the arrows in FIG. 2. When the downward stroke of the surface-mounted pumping unit is complete, the reciprocating action of the sucker rods causes cage plunger 14 to move upwardly as illustrated in FIG. 1 of the drawing. This movement of cage plunger 14 results in an upward movement of ball cage 11, which again seats top ball 10 securely on top ball seat 15 and prevents undesirable reverse flow of the fluid in the middle chamber of working barrel 2 downwardly into the lower chamber of the working barrel. As ball cage 11 and top ball 10 continue to move upwardly, fluid is displaced through fluid outlet 3 in the top chamber of working barrel 3 as valve 7 is unseated from valve seat 8, thus permitting passage of the fluid from working barrel 2 into the collection tubing (not illustrated) as indicated by the arrows. The process is then repeated, with continued pumping resulting in fluid being pumped from working barrel 2 through the tubing and to the surface for storage.

Figure 3:
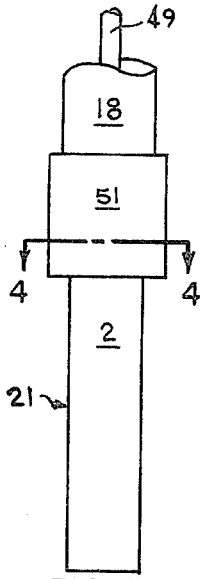
FIG. 3 is an elevation, partially in section, of a preferred embodiment of the sliding valve pump of this invention.
Figure 4:
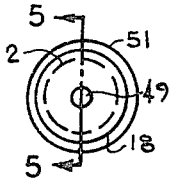
FIG. 4 is a sectional view taken along lines 4—4 in FIG. 3, more particularly illustrating the preferred construction of the sliding valve pump.

Referring now to FIGS. 3 and 4 of the drawing, the sliding valve pump of this invention is generally illustrated by reference numeral 21, and generally comprises working barrel 2, suspended from tubing 18 by means of a seating nipple 51, as hereinafter described. A plunger rod 49 is positioned in the center of working barrel 2 and cooperates with the sucker rod string of a surface-mounted pumping unit in order to provide the necessary reciprocating pumping action. As in the case of conventional oil pump 1, and referring now to FIGS. 5–11 of the drawing, the sliding valve pump 21 of this invention is designed to cooperate with in-place tubing 18 and suspend beneath the bottom of the tubing in a pool of oil and reservoir fluid, as particularly illustrated in FIG. 5 of the drawing. It will be appreciated by those skilled in the art that casing 17 must be "shot" or otherwise cut to create casing apertures 42 in order to facilitate pumping of the fluid from the reservoir pool to the surface. The sliding valve pump 21 is removably carried by tubing 18 by means of a seating nipple 51, which is sealed with respect to working barrel 2 by means of a cooperating O ring 52. Working barrel 2 of sliding valve pump 21 is, in a preferred embodiment of the inventionm, fabricated in three sections for reasons more particularly hereinafter described: an upper working barrel 25; a middle working barrel 26; and a lower working barrel 27, as illustrated. Upper working barrel 25 is preferably provided with a barrel wedge 24 for mating with seating nipple 21, and is also provided with exterior threads 28, designed to mate with the interior working barrel threads 28 of middle working barrel 26. Similarly, the exterior working barrel threads 28 of lower working barrel 27 mate with the interior working barrel threads 28 of middle working barrel 26.

Referring now to FIGS. 5–11 of the drawing, it will be appreciated that the sliding valve pump 21 of this invention is a travelling valve pump with working barrel 2 fitted with top ports or openings 22, provided near the top of upper working barrel 25, and bottom ports 23 provided in the lower segment of middle working barrel 26, as illustrated. An upper valve 33 and a lower valve 43 are positioned in vertical tandem relationship on plunger rod 49 in working barrel bore 29 of working barrel 2, and are fitted with valve ports 35, designed to register sequentially with top ports 22 and bottom ports 23, respectively, of working barrel 2, as plunger rod 49 reciprocates inside working barrel 2. Upper valve 33 includes upper valve skirt 34 and upper valve neck 37, the latter of which is slotted by neck slots 38. Upper valve 33 is joined to plunger rod 49 by means of neck ring 39, which is positioned in neck ring groove 40 in upper valve neck 37, in such a manner that plunger 49 is permitted to slidably reciprocate with respect to upper valve 33, as hereinafter described. Similarly, lower valve 43 is provided with lower valve skirt 44, and lower valve neck 46, and is additionally fitted with shoulder ports 47 to permit passage of the fluid collected in the lower chamber of sliding valve pump 21 into the upper chamber thereof.

Figure 7:
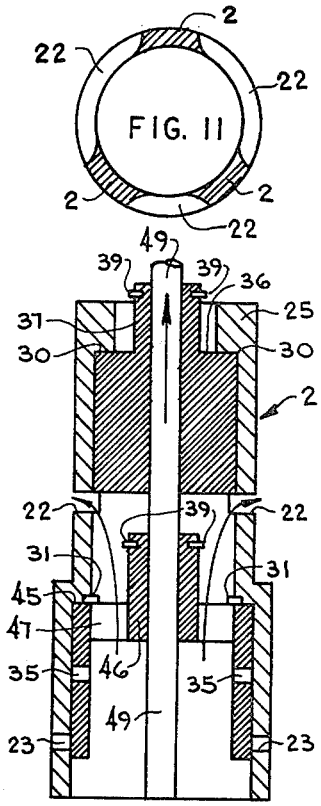
FIG. 7 is a side sectional view of yet another preferred embodiment of the pump illustrated in FIGS. 3 and 4.
Figure 6:
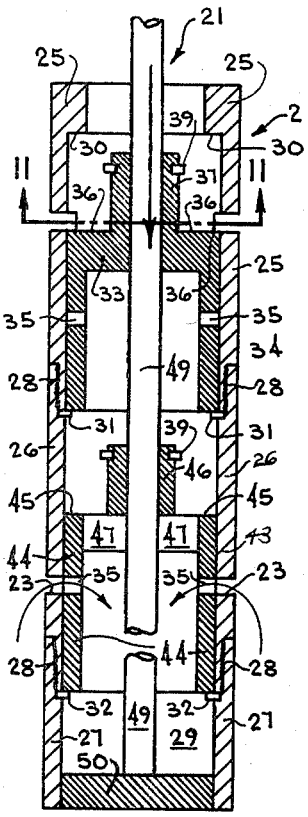
FIG. 6 is a sectional view of the pump illustrated in FIGS. 3-5, also taken along lines 5—5 of FIG. 4.
Figure 8:
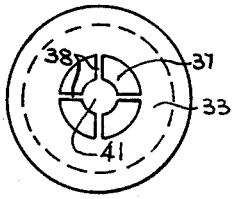
FIG. 8 is a top elevation of a preferred sliding valve in the top position of the pump of this invention.
Figure 9:
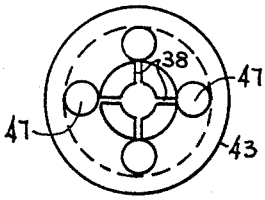
FIG. 9 is a top elevation of a preferred lower sliding valve of the pump of this invention.
Figure 10:
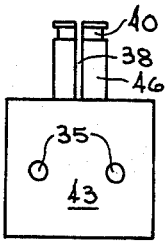
FIG. 10 is a side elevation of the valve illustrated in FIGS. 8 and 9.
Figure 5:
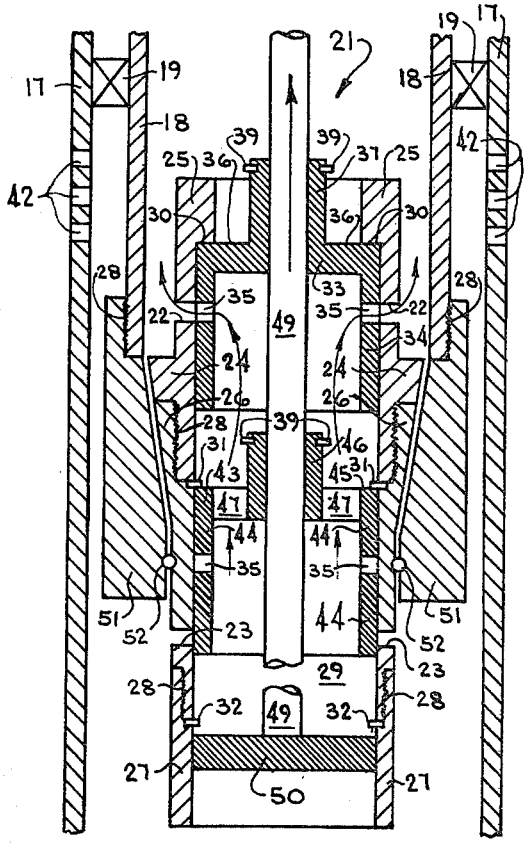
FIG. 5 of the drawing is a sectional view of the sliding valve pump illustrated in FIGS. 3 and 4, taken along lines 5—5 of FIG. 4.

Referring now specifically to FIGS. 5–7, upper valve stops 31 are provided in middle working barrel 26 in order to mate with lower valve shoulders 45 of lower valve 43, and prevent lower valve 43 from moving past this point in working barrel 2 with continued upward motion of plunger rod 49 inside working barrel bore 29. In similar manner, working barrel bore shoulders 30, formed in the upper interior of working barrel bore 29, is designed to prevent upper valve 33 from moving past this point inside working barrel 29 with continued reciprocation of plunger rod 49. Accordingly, as illustrated in FIG. 5, when upper valve shoulders 36 contact working barrel bore shoulders 30, valve ports 35 of upper valve 33 are caused to register with top ports 22 provided in working barrel 2, to facilitate flow of fluid from the lower chamber of working barrel 2, through shoulder ports 47 of lower valve 43, and into the annulus between tubing 18 and working barrel 2, as indicated by the arrows. Simultaneous contact between lower valve shoulders 45 of lower valve 43 and upper valve stops 31 also serves to insure that lower valve skirt 44 covers bottom ports 23 in working barrel 2, in order to prevent the flow of fluid from the interior of barrel 2 back through bottom ports 23 and into the oil pool.

Referring now to FIG. 6 of the drawing, when the sucker rod string reverses direction and starts down, plunger rod 49 likewise moves downward, and upper valve 33 and lower valve 43 are displaced downwardly on plunger rod 49 until the bottom of upper valve skirt 34 contacts upper valve stop 31, and the bottom of lower valve skirt 44 contacts lower valve stop 32. At this point, plunger rod 49 continues sliding downwardly inside plunger rod apertures 41 of upper valve 33 and lower valve 43, and fluid from the fluid reservoir enters working barrel 2 by means of registering valve ports 35 located in lower valve skirt 44 provided in working barrel 2, and bottom ports 23, which are now in alignment. Since plunger 50 seals the bottom portion of working barrel 2 from fluid in the oil pool, the pressured fluid must enter working barrel 2 through registering bottom ports 23 and valve ports 35, as illustrated by the arrows. This action, coupled with the reservoir pressure, causes the lower chamber of working barrel 2 to fill with fluid, and as the pump begins its upward reciprocating motion, the process of pumping is repeated, with the fluid being pumped from the lower chamber of working barrel 2 upwardly through shoulder ports 47 of lower valve 43, and through registering valve ports 35 and top ports 22, as illustrated in FIG. 5, and as heretofore described.

Referring now particularly to FIG. 7 of the drawing, it will be appreciated that the efficiency of the sliding valve pump 21 of this invention is improved by increasing the size of the annular space between working barrel 2 and tubing 18. Accordingly, in another preferred embodiment of the invention, upper valve 33 is solid in construction and is fitted inside upper working barrel 25 of working barrel 2 in such manner that on the upward stroke of plunger rod 49, when upper valve shoulders 36 of upper valve 33 are forced against working barrel bore shoulder 30, top ports 22 in working barrel 2 are open and fluid is permitted to flow out of top ports 22 below upper valve 33 and into the annulus defined by tubing 18 and upper working barrel 25. Since upper valve 33 is reduced in diameter as compared to the upper valve 33 illustrated in FIGS. 5 and 6 of the drawing, the annular space between tubing 18 and the outer wall of working barrel 2 is increased, thereby increasing the area through which the fluid may be pumped. In this embodiment of the invention, it is preferred that the diameter of lower valve 43 be kept in the same dimension as the valve illustrated in FIGS. 5 and 6 of the drawing, in order to maximize the fluid flow area of shoulder ports 47.

Referring now to FIG. 11 of the drawing, it will be appreciated that in another preferred embodiment of the invention, working barrel 2 can be fitted with top ports 22 and bottom ports 23 by simply cutting a selected distance into the barrel to create slotted ports 22 as illustrated. The size of the ports can be varied by the depth of the cut and the width of the blade used to make the cut.

As heretofore described, working barrel 2 is provided in three segments, upper working barrel 25; middle working barrel 26; and lower working barrel 27; all as particularly illustrated in FIGS. 5 and 6 of the drawing. The division of working barrel 2 into these three segments greatly facilitates construction of sliding valve pump 21, since it permits upper valve 33 to be positioned in working barrel bore 29 inside upper working barrel 25 and lower valve 43 to be fitted inside middle working barrel 26, with subsequent joining of upper working barrel 25 and middle working barrel 26 by means of working barrel threads 28. A plunger 50 of suitable size can then be threaded on or otherwise attached to one end of plunger rod 49, and inserted in working barrel bore 29 of lower working barrel 27, and the plunger rod 49 positioned in registering relationship with plunger rod apertures 41 of upper valve 33 and lower valve 43. A neck ring 39 is then snapped into each neck ring groove 40 provided in upper valve neck 37 and lower valve neck 46, respectively, to slidably secure upper valve 33 and lower valve 43 on plunger rod 49. A seating nipple 51 or an equivalent sealing means, has previously been provided on the bottom end of tubing 18 in order to cooperate with the sliding valve pump 21, and the pump can be lowered into position in cooperation with the seating nipple 51 to begin the pumping operation.

It will be appreciated by those skilled in the art that the sliding valve pump of this invention can be designed to cooperate with tubing of substantially any desired size, although under ordinary circumstances it is designed to fit standard tubing having an inside diameter of 2 inches. Accordingly, the working barrel 2 of sliding valve pump 21 will normally be characterized by an outside diameter of $1\frac{7}{8}$ inches, and an inside diameter of $1\frac{1}{2}$ inches. In a preferred embodiment of the invention, upper valve 33 and lower valve 43 will have an outside diameter of about $1\frac{1}{2}$ inches, with approximately 0.001 of an inch clearance between upper valve 33 and lower valve 43 and the inside wall or working barrel bore 29, of working barrel 2. However, it will be appreciated by those skilled in the art that this clearance will vary depending upon the working pressure in the well, and whether or not O rings or other sealing techniques are used to seal upper valve 33 and lower valve 43. Similarly, the length of plunger 50 will vary depending upon the pressure conditions of the well and the use of alternative sealing means, and the clearance between plunger 50 and working barrel bore 29 of working barrel 2 and between upper valve 33 and plunger rod 49 will also vary with such working pressure, although in a preferred embodiment, this clearance is 0.001 of an inch.

In another preferred embodiment of the invention, four valve ports 35 are provided in both upper valve 33 and lower valve 43, to match the three slotted top ports and three bottom ports on working barrel 2, although it will be appreciated by those skilled in the art that fewer or more ports may be provided depending upon the flow characteristics of the particular well being pumped. Furthermore, while each port is preferably about $\frac{3}{8}$ of an inch in diameter, the size of these ports will also vary according to the pressure and flow conditions of the particular well being pumped. Similarly, in a preferred embodiment of the invention, shoulder ports 47 are about $\frac{1}{4}$ of an inch in diameter; however, the size of these ports will also depend upon the fluid flow characteristics of the area between the lower and upper chambers of working barrel 2 and the annulus defined by tubing 18 and working barrel 2.

It will be appreciated by those skilled in the art that a key aspect of the invention lies in the design of the valve and port arrangement and in the cooperation between the plunger rod and valves to eliminate gas "lock". Referring again to FIGS. 5 and 6 of the drawing, the expensive problem of gas "lock" in conventional pumps is conveniently avoided by suspending working barrel 2 of sliding valve pump 21 beneath the bottom of tubing 18 and providing a lower valve 43 with shoulder ports 47 and valve ports 35, the latter of which register with bottom ports 23 of working barrel 2. Accordingly, referring now to FIG. 6 of the drawing, when plunger rod 49 is moving downwardly and valve ports 35 and bottom ports 23 are in alignment, fluid of any description, whether it be gas, liquid or a mixture of the two, is permitted to enter the bottom chamber of working barrel 2. When plunger rod 49 begins its upward travel as illustrated in FIG. 5 of the drawing, all of the liquid contained in the charge will be forced upwardly through shoulder ports 47 of lower valve 43 and ultimately through registering vavle ports 35 in upper valve 33 and top ports 22 in upper valve skirt 34 of upper valve 33 against the fluid column standing in tubing 18. However, if a charge of fluid contains primarily gas, the gas will simply be compressed inside the working barrel 2, and may or may not flow into tubing 18, depending upon the fluid pressure in tubing 18. For example, the fluid pressure in tubing 18 may be sufficiently great to prevent upper valve 33 to move upwardly on plunger rod 49 to the point where valve ports 35 and top ports 22 register. If the gas does not flow from working barrel 2, the pumping cycle is repeated until enough liquid is collected to force upper valve 33 against working barrel bore shoulder 30, and the charge from valve ports 35 and top ports 22 against the fluid column pressure in tubing 18. Furthermore, when the charge is primarily gas, excess gas is vented from registering valve ports 35 and bottom ports 23 into the fluid reservoir each time plunger rod 49 makes a down stroke, as illustrated in FIG. 6. This venting of excess gas, coupled with the equalizing of pressure inside working barrel 2 on both sides of lower valve 43 by means of shoulder ports 47, eliminates gas "lock" which is characteristic of conventional oil well pumps. For example, referring to FIG. 1 of the drawing, in conventional oil pump 1, if a charge of gas is initially drawn into working barrel 2, it may not be under sufficient pressure when compressed by the action of ball cage 11 and top ball check 10 to exit fluid outlet 3, due to the fluid pressure inside tubing 18. Accordingly, when the cage plunger 14 starts down as illustrated in FIG. 2, the pressure of the gas in working barrel 2 holds bottom ball check 16 on bottom ball seat 20, and continues to force bottom ball check 16 on bottom ball seat 20 when cage plunger begins another upward movement. The pump is then gas "locked" and simply moves through the pumping sequence with no fluid flow.

It will be further appreciated by those skilled in the art that the materials of construction used in the fabrication of the sliding valve pump of this invention may vary according to the particular conditions of the well being pumped, with stainless steel being a normal choice. Furthermore, in the embodiment of the invention illustrated in FIG. 7 of the drawing, while it is preferred that upper valve 33 be solid, it will be appreciated that the valve may be constructed as illustrated in FIGS. 5 and 6 of the drawing with an upper valve skirt 34 and a hollow interior, as desired, so long as the valve is so positioned to permit it to clear top ports 22 when it is in the top of working barrel 2.

Having described my invention with the particularity set forth above, what is claimed is:

1. A sliding valve pump for removing fluid from an oil well reservoir comprising:

(a) a working barrel having an internal bore and at least two barrel ports in the wall thereof;

(b) a plunger rod in said bore and adapted for reciprocating motion in said bore with respect to said working barrel;

(c) a plunger carried by said plunger rod and slidably traversing a portion of the length of said bore when said plunger rod is reciprocating;

(d) upper valve means slidably carried by said plunger rod and slidably disposed in said bore in the upper segment of said working barrel, said upper valve means having at least one valve port;

(e) lower valve means slidably carried by said plunger rod and slidably disposed in said bore in the lower segment of said working barrel below said upper valve means, said lower valve having at least one shoulder port and at least one valve port; and (f) valve stops carried by said working barrel and projecting into said bore to selectively interrupt the travel of said upper valve means and said lower valve means and effect selective registration of said valve port and said barrel ports when said plunger rod is caused to reciprocate in said working barrel.

2. The pump of claim 1 wherein said upper valve means and said lower valve means are each characterized by an upwardly extending neck having a plunger rod aperture; a plurality of vertical slots; and a horizontal groove in the circumference of said neck; and further comprising a removable clip or ring in cooperation with said groove to slidably secure said upper valve means and said lower valve means in vertical tandem relationship on said plunger rod.

3. The pump of claim 1 further comprising a seating nipple in threaded cooperation with the bottom end of a length of tubing set in said well, and external wedge means on said working barrel for seating said working barrel inside said tubing and positioning said pump in said reservoir.

4. The pump of claim 1 wherein:

(a) said working barrel is characterized by an upper working barrel, a middle working barrel, and a lower working barrel to facilitate insertion of said upper valve means in said upper working barrel; said lower valve means in said middle working barrel; and said valve stops in said middle working barrel and said lower working barrel; and said plunger in said lower working barrel; and (b) said upper valve means and said lower valve means are each characterized by an upwardly extending neck having a plunger rod aperture; a plurality of vertical slots; and a horizontal groove in the circumference of said neck; and further comprising a removable clip or ring in cooperation with said groove to slidably secure said upper valve means and said lower valve means in vertical tandem relationship on said plunger rod.

5. The pump of claim 1 wherein said upper valve means and said lower valve means include a downwardly extending, generally cylindrically shaped skirt, and said valve ports are provided in said skirt.

6. The pump of claim 1 wherein said upper valve means and said lower valve means are each characterized by a downwardly extending, generally cylindrically shaped skirt fitted with said valve ports, and an upwardly extending neck having a plunger rod aperture; a plurality of vertical slots; and a horizontal groove in the circumference of said neck; and further comprising a removable clip or ring in cooperation with said groove to slidably secure said upper valve means and said lower valve means in vertical tandem relationship on said plunger rod.

7. The pump of claim 1 wherein said working barrel is characterized by an upper working barrel, a middle working barrel, and a lower working barrel to facilitate insertion of said upper valve means in said upper working barrel; said lower valve means in said middle working barrel; said valve stops in said middle working barrel and said lower working barrel; and said plunger in said lower working barrel.

8. The pump of claim 2 wherein said upper valve means and said upper working barrel are smaller in diameter than said lower valve means and said middle working barrel, and said upper valve means is solid.

9. A sliding valve pump comprising:

(a) An upper working barrel having an internal upper working barrel bore, a barrel shoulder formed in the tip of said bore, and a first plurality of barrel ports provided in the wall of said working barrel beneath said barrel shoulder;

(b) a generally cylindrically shaped upper valve slidably positioned in said upper working barrel bore and further characterized by an upper valve neck, a plunger rod aperture in said upper valve neck, an upper valve skirt, and a plurality of valve ports in the wall of said upper valve skirt for registration with said first barrel ports when said upper valve is positioned in the top of said upper working barrel bore against said barrel shoulder.

(c) a middle working barrel attached to and in registration with said upper working barrel and having an internal middle working barrel bore, and a second plurality of barrel ports provided in the wall of said middle working barrel near the bottom of said middle working barrel;

(d) a first valve stop carried by said middle working barrel and projecting into said middle working barrel bore to interrupt the downward travel of said upper valve and the upward travel of said lower valve;

(e) a lower working barrel having an internal lower working barrel bore and attached to and in registration with said middle working barrel;

(f) a second valve stop carried by said lower working barrel and projecting into said lower working barrel bore to interrupt the downward travel of said lower valve and facilitate alignment of said valve ports on said lower valve with said second plurality of barrel ports;

(g) a generally cylindrically shaped lower valve slidably positioned in said middle working barrel bore beneath and in vertical tandem relationship with said upper valve, and further characterized by a lower valve neck, a plunger rod aperture in said lower valve neck, a lower valve skirt, a plurality of shoulder ports in the top of said lower valve and a plurality of valve ports in the wall of said lower valve skirt for registration with said second barrel ports when said lower valve skirt of said lower valve is positioned against said second valve stop;

(h) a plunger rod in registration with said plunger rod apertures in said upper valve neck and said lower valve neck and extending through said upper working barrel bore and said middle working barrel bore and projecting into said lower working barrel bore; and (i) a plunger carried by said plunger rod and fitted in said lower working barrel bore to seal said lower working barrel.

10. The pump of claim 9 wherein said upper valve neck and said lower valve neck each further include vertical neck slots, a horizontal groove, and a neck ring for insertion in said groove to facilitate slidable clamping of said upper valve and said lower valve on said plunger rod.

11. The pump of claim 9 wherein the diameter of said upper working barrel and said upper valve is smaller than the diameter of said middle working barrel and said lower valve, and wherein said upper valve is solid, and said top barrel ports are open when said upper valve is touching said barrel shoulder of said upper working barrel.

* * * * *